United States Patent [19]

Kolb

[11] Patent Number: 4,673,331

[45] Date of Patent: Jun. 16, 1987

[54] AXIAL BLOWER

[75] Inventor: Werner Kolb, Zweibrücken, Fed. Rep. of Germany

[73] Assignee: Turbo-Luft-Technik GmbH, Zweibrücken, Fed. Rep. of Germany

[21] Appl. No.: 825,205

[22] Filed: Feb. 3, 1986

[30] Foreign Application Priority Data

Nov. 8, 1985 [DE] Fed. Rep. of Germany ..... 3539604

[51] Int. Cl.[4] ..... F04D 29/54

[52] U.S. Cl. ..... 415/53 R; 415/185; 415/DIG. 1

[58] Field of Search ..... 415/53 R, DIG. 1, 185, 415/191, 207, 208, 219 R, 213 C

[56] References Cited

U.S. PATENT DOCUMENTS

| | | | |
|---|---|---|---|
| 3,995,970 | 12/1976 | Nobuyuki | 415/208 X |
| 4,375,937 | 3/1983 | Cooper | 415/53 R |
| 4,511,308 | 4/1985 | Russell et al. | 415/191 |

FOREIGN PATENT DOCUMENTS

| | | | |
|---|---|---|---|
| 122892 | 10/1984 | European Pat. Off. | 415/208 |
| 747919 | 5/1943 | Fed. Rep. of Germany | 415/191 |
| 2361788 | 6/1975 | Fed. Rep. of Germany | 415/208 |
| 57-110800 | 7/1982 | Japan | 415/53 R |
| 85/00640 | 2/1985 | PCT Int'l Appl. | 415/53 R |

*Primary Examiner*—Robert E. Garrett
*Assistant Examiner*—Joseph M. Pitko
*Attorney, Agent, or Firm*—Max Fogiel

[57] ABSTRACT

An axial blower with an intake that tapers conically into a cylindrical component. An impeller rotates inside the cylindrical component. A stationary channeling ring of approximately the same diameter as the cylindrical component is positioned upstream of the impeller and surrounded by an annular channel. The channeling ring is approximately equidistant from each end of the annular channel. Diversion blades are positioned inside the annular channel and adjusted in relation to its axis. To make the blower easier and less expensive to manufacture and to increase its breakaway limit, the diversion blades consist of flat sheets of metal and both their upstream and their downstream edges slope.

4 Claims, 7 Drawing Figures

AXIAL BLOWER

BACKGROUND OF THE INVENTION

The present invention relates to an axial blower of the type known from *VGB-Kraftwerkstechnik* 15, 159–165 (1977). The breakaway of the medium flowing through this known blower can be decreased at lower volumes. The backstreaming that occurs at the outside diameter of the impeller is locally stabilized in an annular bypass channel, with diversion blades in the annular channel straightening out the twist that occurs within the backstreaming.

Another axial blower is known from International Patent Application No. WO 85/00640. The diversion blades inside the annular channel are curved. Axial blowers with diversion blades of this type are expensive to manufacture.

SUMMARY OF THE INVENTION

The object of the present invention is an axial blower of the aforesaid type that is easier to manufacture and has a higher breakaway limit.

The flat diversion blades in accordance with the invention are easier and less expensive to manufacture than curved blades. The also slanting downstream edge of the diversion blades has a beneficial effect on the breakaway. The flat diversion blades can either be positioned along the axis and slope toward one diameter of the blower or along a radius and slope toward the circumference of the channeling ring.

Although International Patent Application No. WO 82/01919 does describe an axial blower with flat diversion blades, the blades are positioned strictly radially and strictly axially and the channeling ring is connected to a wall that demarcates the end of the annular channel that faces away from the impeller. Thus, the air cannot emerge radially at that point, which is a considerable detriment to the effectiveness of the blower.

Preferred embodiments of the invention will hereinafter be described with reference to the appended drawings. It is to be understood, however, that these are merely by way of example and that the scope of the protection sought for the invention is defined exclusively in the claims.

DETAILED DESCRIPTION OF THE PREFERRED EMBODIMENTS

Figure 1:
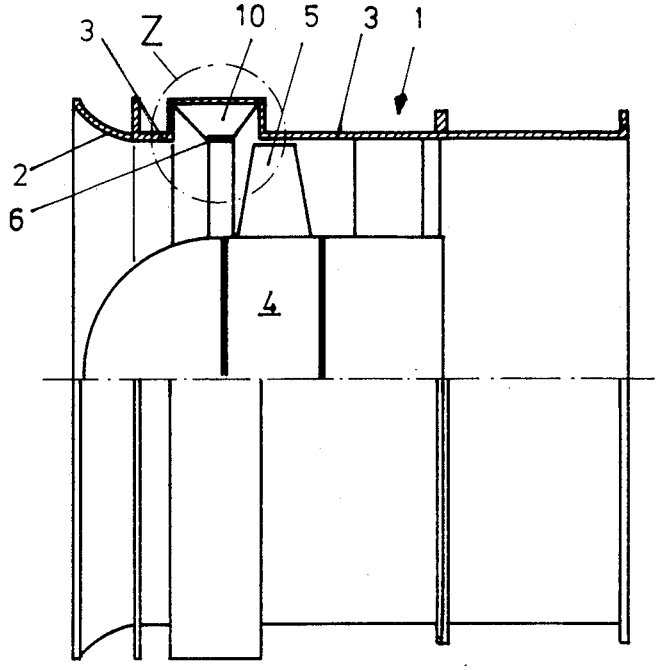
FIG. 1 is partly a longitudinal section thorough and partly a front view of an axial blower in accordance with the invention.

An axial blower has a housing 1 with an intake 2 that tapers conically into a cylindrical component 3. An impeller 4 with adjustable blades 5 rotates inside cylindrical housing component 3.

Upstream of impeller 4 is a device that stabilizes the breakaway limit. This device consists of a channeling ring 6 surrounded by an annular channel 7. Annular channel 7 is demarcated radially outside by the surface of housing 1, which is larger at that point, and laterally by two walls 8 and 9. The walls 8 and 9 illustrated in FIGS. 1 and 2 extend perpendicular to cylindrical housing component 3. Walls 8 and 9 can, however, taper conically as illustrated in FIG. 7 or one can be perpendicular and the other taper conically.

Figure 2:
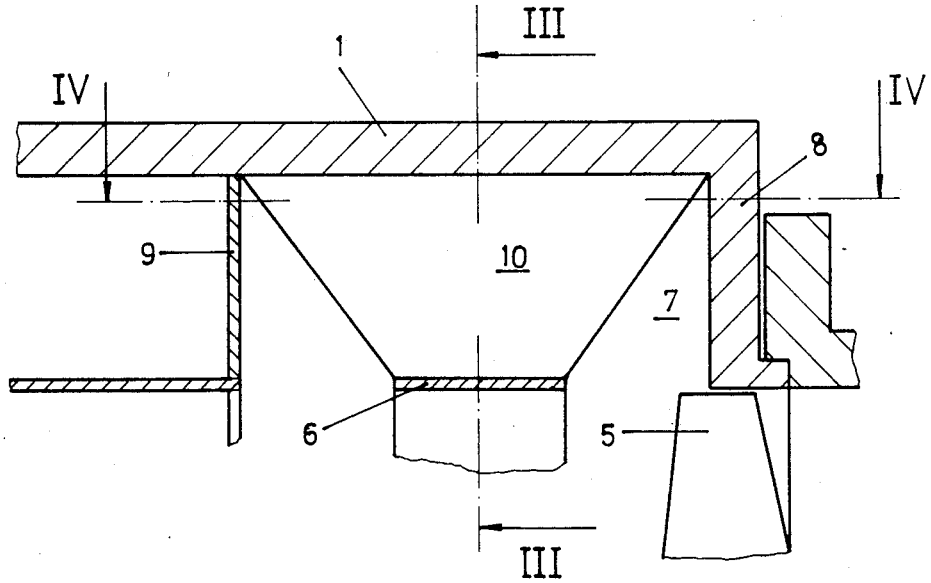
FIG. 2 is a detail of the area Z in FIG. 1.
Figure 7:
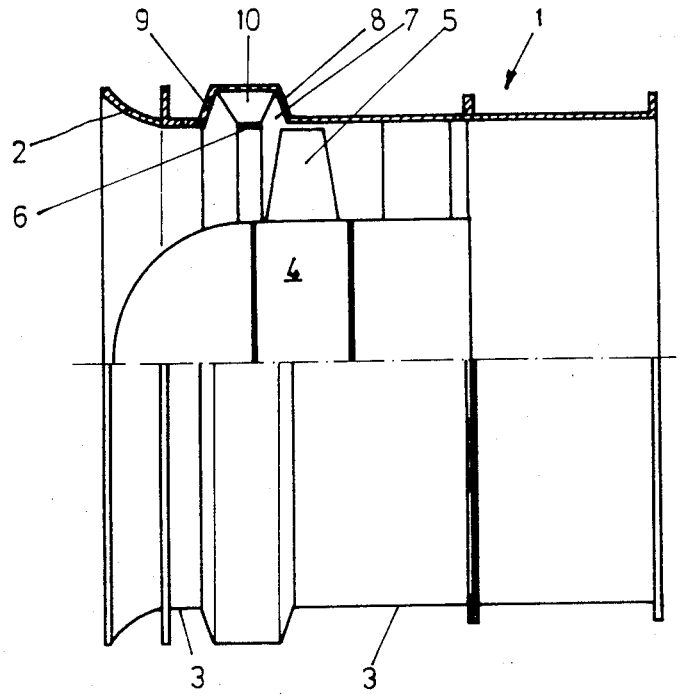
FIG. 7 is partly a longitudinal section thorough and partly a front view of another embodiment of the axial blower in accordance with the invention.

The channeling ring 6 illustrated in FIGS. 1 and 7 is inside cylindrical housing component 3. It has approximately the same diameter as component 3, although it is shorter axially than annular channel 7. Channeling ring 6 is positioned in relation to annular channel 7 in such a way that it is approximately equidistant from each wall 8 and 9, leaving an aperture both upstream and downstream of annular channel 7.

Diversion blades 10 that orient the particular backstreaming that is to be adjusted are positioned inside annular channel 7. Diversion blades 10 are connected to channeling ring 6 and to housing 1. Both the upstream and downstream edges of diversion blades 10 slope out and their length increases radially.

Figure 3:
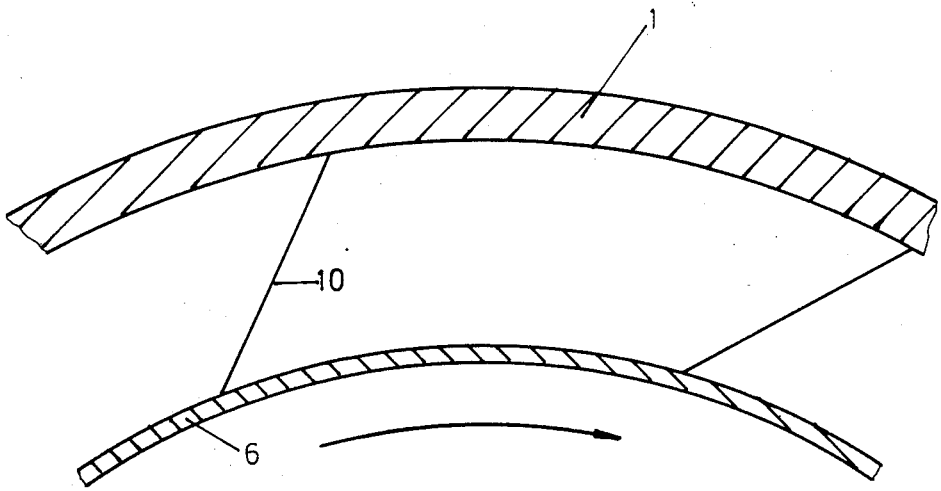
FIG. 3 is a section along the line III—III in FIG. 2.
Figure 4:
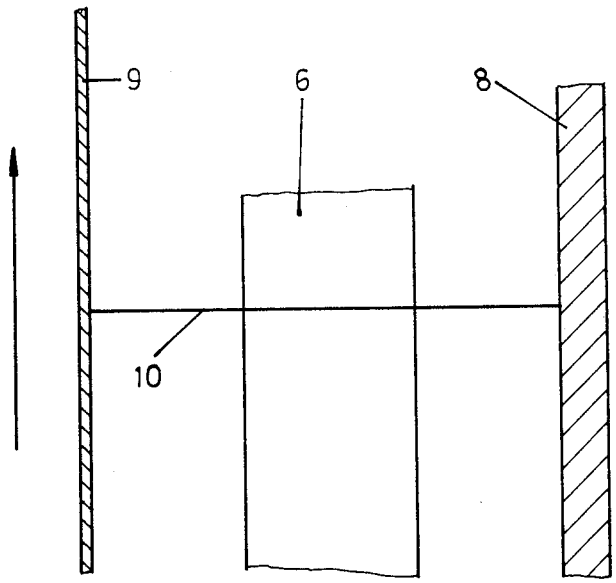
FIG. 4 is a section along the line IV—IV in FIG. 2.
Figure 5:
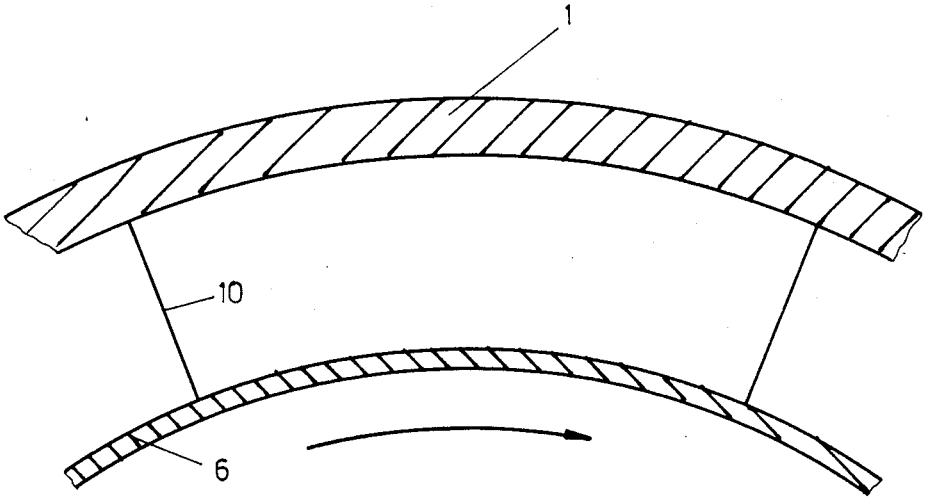
FIG. 5 is also a section along the line III—III in FIG. 2 but through a different embodiment.
Figure 6:
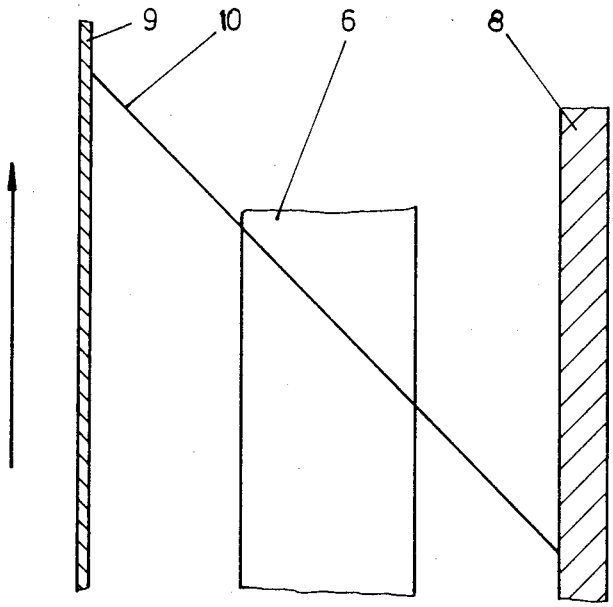
FIG. 6 is a section along the line IV—IV in FIG. 2 but through the second embodiment.

Diversion blades 10 consist of flat sheets of metal adjusted in relation to the longitudinal axis of annular channel 7. The diversion blades 10 illustrated in FIGS. 3 and 4 are positioned parallel to the axis and slope in relation to one diameter of channeling ring 6. The diversion blades 10 in the embodiment illustrated in FIGS. 5 and 6 are positioned radially and slope toward the circumference of channeling ring 6. The arrows in these figures indicate the direction that impeller 4 rotates in. Each angle of slope should be between 20° and 70°. It is 45° in the axial blowers illustrated in the figures.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

I claim:

1. Axial blower comprising: a casing with an axis including a cylindrical portion and an inlet portion, said inlet portion tapering conically into said cylindrical portion; an impeller rotating inside said cylindrical portion; a stationary ring of substantially the same diameter as said cylindrical portion positioned upstream of said impeller; an annular channel surrounding said stationary ring and having ends; said stationary ring being equidistant from each end of said annular channel; and guide vanes with upstream and downstream edges, said guide vanes being positioned inside said annular channel and fixed to said stationary ring and said casing of the blower, said guide vanes comprising flat sheets of metal, said upstream and downstream edges sloping out from said stationary ring to said casing, said guide vanes being positioned parallel to the axis of said casing and at an angle to a radius of said casing.

2. Axial blower comprising: a casing with an axis including a cylindrical portion and an inlet portion, said inlet portion tapering conically into said cylindrical portion; an impeller rotating inside said cylindrical portion; a stationary ring of substantially the same diameter as said cylindrical portion positioned upstream of said impeller; an annular channel surrounding said stationary ring and having ends; said stationary ring being equidistant from each end of said annular channel; and guide vanes with upstream and downstream edges, said guide vanes being positioned inside said annular channel and fixed to said stationary ring and said casing of the blower, said guide vanes comprising flat sheets of metal, said upstream and downstream edges sloping out from said stationary ring to said casing, said guide vanes being positioned parallel to the axis of said casing and at an angle to a radius of said casing, said casing having a circumference, said guide vanes being positioned radially with respect to said casing and at an angle to the circumference of said casing.

3. Axial blower comprising: a casing with an axis including a cylindrical portion and an inlet portion, said inlet portion tapering conically into said cylindrical portion; an impeller rotating inside said cylindrical portion; a stationary ring of substantially the same diameter as said cylindrical portion positioned upstream of said impeller; an annular channel surrounding said stationary ring and having ends; said stationary ring being equidistant from each end of said annular channel; and guide vanes with upstream and downstream edges, said guide vanes being positioned inside said annular channel and fixed to said stationary ring and said casing of the blower, said guide vanes comprising flat sheets of metal, said upstream and downstream edges sloping out from said stationary ring to said casing, said guide vanes being positioned parallel to the axis of said casing and at an angle to a radius of said casing; said flat sheet metal guide vanes being inclined to two planar walls which are perpendicular to each other within said annular channel, said annular channel having a front end where a main flow stream is present, said blower forming a swirl entering said annular channel in front of said impeller and then flowing back and re-entering the main flow stream at the front end of said annular channel, said annular channel being positioned outside the main flow stream and is flowed through only by a backstream, said guide vanes preventing substantially breakaway of flow at vanes on said impeller.

4. An axial blower as defined in claim 3, wherein said angle is between 20 degrees and 70 degrees.

* * * * *